United States Patent [19]

Lamb

[11] 3,997,095

[45] Dec. 14, 1976

[54] SINGLE FACE WEB WEAVE CONTROL

[75] Inventor: Francis M. Lamb, Fairmount, Ind.

[73] Assignee: Owens-Illinois, Inc., Toledo, Ohio

[22] Filed: Mar. 5, 1976

[21] Appl. No.: 664,209

[52] U.S. Cl. ..... 226/195; 226/39; 226/109; 242/75.2

[51] Int. Cl.[2] ..... B65H 23/16

[58] Field of Search ..... 226/15, 38, 39, 109, 226/110, 195; 242/75.2

[56] References Cited

UNITED STATES PATENTS

| | | | |
|---|---|---|---|
| 3,111,285 | 11/1963 | Coker et al. | 242/75.2 |
| 3,540,674 | 11/1970 | Okamura | 242/75.2 X |
| 3,872,510 | 3/1975 | Childress et al. | 226/195 X |

*Primary Examiner*—Robert W. Saifer
*Attorney, Agent, or Firm*—D. T. Innis; E. J. Holler

[57] ABSTRACT

Apparatus is described for preventing web weave from occurring at the exit from a corrugator bridge wherein a single face corrugated board is being drawn from the bridge by a glue machine. The single face web may be present on what is termed the upper bridge or the lower bridge and control is maintained by providing a friction plate faced with canvas which is biased against the single face web as it is traveling over an exit guide roll. Typically, a single face board is produced on a corrugator in widths of 80 to 86 inches and the friction plate is less in length than half the width of the paper. The drag force is regulatable by an operator adjustment of air pressure being delivered to biasing air cylinders.

9 Claims, 3 Drawing Figures

SINGLE FACE WEB WEAVE CONTROL

BACKGROUND OF THE INVENTION

In the production of corrugated board, whether it be single face, single wall or double wall, where there are two corrugated mediums between two outer liners and an intermediate liner, it has been a problem to control the weave of the single face corrugated board which is first made and then used in combination with a liner board or with a single wall board to form the completed corrugated board. In the making of single face board on a corrugator, the single face board after issuing from the corrugator is moved to what is termed a corrugator bridge which, in effect, is an elongated overhead area spanning a portion of length of the in-line machine. At the exit end of the bridge is positioned a glue machine which in turn is in front of a double facer. These bridges are formed as an elongated table underlying the riffled single face which is accumulated on the bridge. The exits to the corrugator bridge, whether there be one or two bridges, basically have an exit roller and in the particular environment of the application disclosed herein there are shown two idler rolls over which the corrugated single face moves with the corrugated portion in contact with the idler rolls and the liner face passing under an intermediate arcuate guide. As the corrugated single face board passes over the exit idler, frequently the web has tended to weave laterally relative to its line of movement. Weaving at this point will result in the single face board being joined to the liner in an out-of-alignment condition. The edges of the formed board will then require trimming and producing unacceptable and uneven board results in high waste percentage.

Past methods have seen the use of drag belts placed over the running web or webs. Attempts have been made to use hydraulically operated, movable rollers referred to as "web directors" to try and steer the web in its path. It has been known to wrap the webs around pipes and/or rollers to try to induce drag also in an attempt to control the web. It has been applicant's experience that all of these methods have proved ineffective to prevent web weave.

SUMMARY OF THE INVENTION

This invention is directed to a web weave control for single face corrugated board exiting over a bridge guide roll by the use of an elongated plate contacting the upper surface of the board as it passes over the bridge exit guide roll. The plate is pneumatically actuated in a downward direction with a controllable pressure settable by the operator to prevent crush, yet with sufficient force to prevent web weave.

DETAILED DESCRIPTION OF THE DRAWINGS

Figure 1:
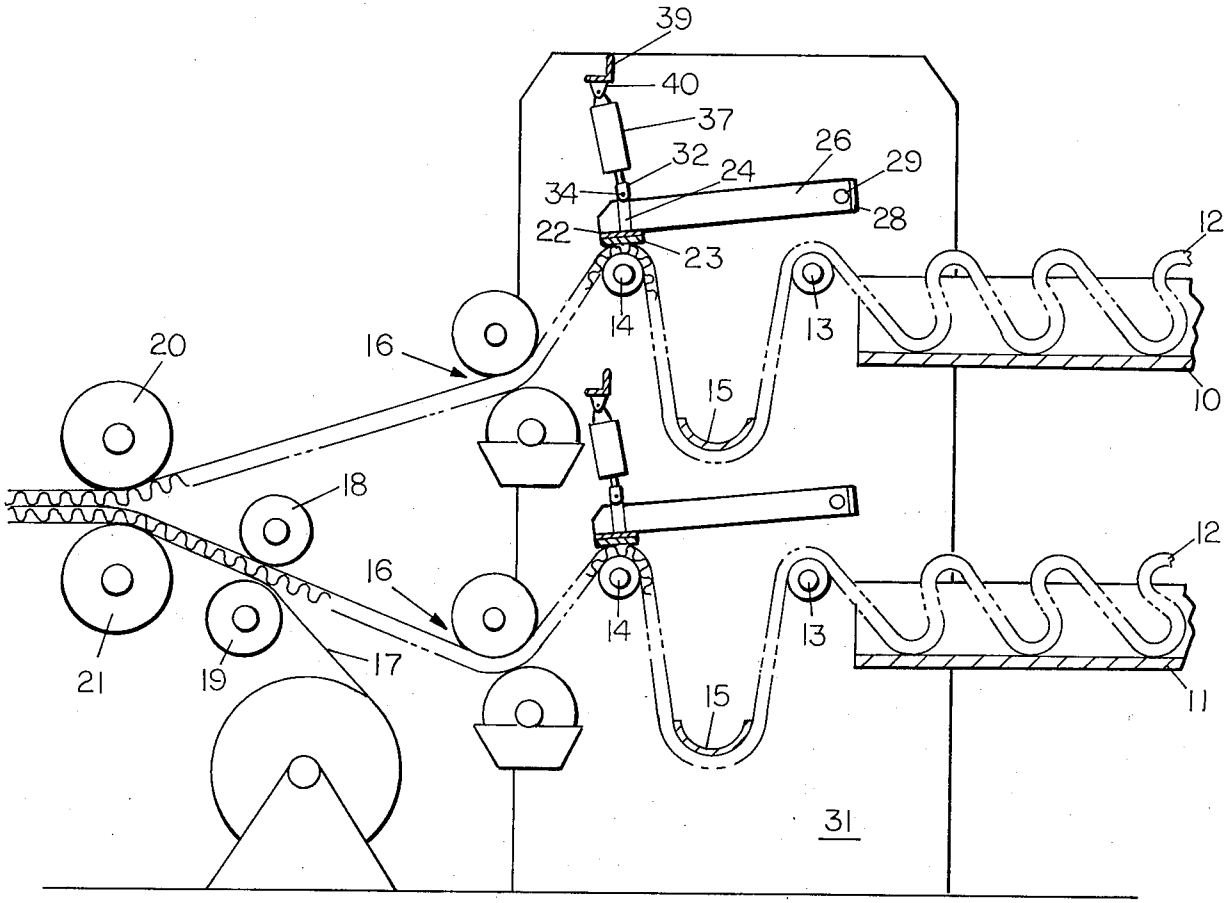
FIG. 1 is a side elevational view of the apparatus of the invention showing schematically the environment in which the invention is used.

With particular reference to FIG. 1, there is shown a pair of corrugator bridges 10 and 11 on which single face corrugated board 12 is shown in what might be termed a "riffled" condition. It should be understood that the single face board 12 has been supplied to the bridges 10 and 11 usually with different flute sizes for each bridge. For example, the upper bridge 10 might have single face board with "B" flute, while the lower bridge 11 might contain "C" flute. The single face board on the bridges is drawn from the bridge through bridge guides in the form of spaced-apart idler rolls 13 and 14. Beneath and between the area of the idler rolls 13 and 14 there is provided a curved plate 15 and, as can be seen in FIG. 1, single face board is drawn over the first roll 13 and threads beneath the curved plate 15 and then over the exit idler roll 14. After passing over the exit idler roll 14, the board is conveyed to glue machines schematically shown at 16 where glue is applied to the tips of the flutes of the single face and in the case of the lower bridge output, a liner board 17 is brought into contact with the flute tips having the glue thereon and becomes adhered to the single face, thus producing single wall board. This occurs in the lower section at nip rolls 18 and 19. It should be understood that additional drying and heating may occur at appropriate places following the position of the nip rolls 18 and 19. As schematically shown, the movement of the single wall board in the lower section into contact with the glued flutes of the upper web of single face and passing between a second set of nip rolls 20 and 21 will produce double wall board.

Figure 2:
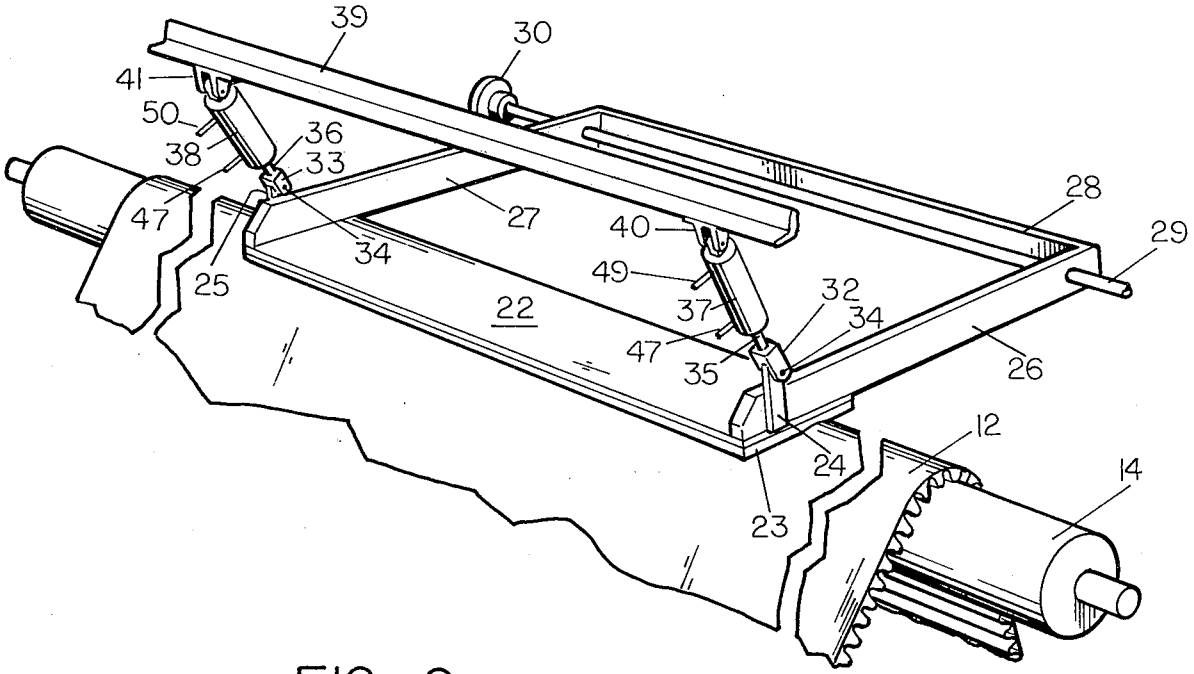
FIG. 2 is a perspective view of the operative portion of the invention.

The principal aspect of the invention is the ability to prevent the web 12 from weaving as it passes over the exit idler roll 14 and with this in view and with reference to FIG. 2, an elongated plate 22, faced with cotton belting 23, is positioned to bear against the upper surface of the web 12. As a specific example of a successful installation the plate size was 6 inches wide by 28 inches long with the belting being of substantially the same size and approximately three-eighths of an inch thick. The plate 22 at its ends is connected to the forward extending end of a pair of arms 26 and 27. The forward ends of the arms have a pair of side brackets 24 and 25 fastened thereto. The opposite ends of the arms 26 and 27 are held together by a rear brace 28. The ends of the arms 26 and 27 adjacent the rear brace 28 are pivotally supported by pivot shaft 29. The pivot shaft 29 is supported at its ends by a shaft bearing 30, only one of which is shown in FIG. 2, it being understood that the shaft bearings will be supported by a bridge guide 31 which takes the form of a pair of spaced-apart vertically extending plates. The bridge guide 31 also supports the idler rolls 13 and 14 and the curved plates 15.

The side brackets 24 and 25 are respectively connected to clevises 32 and 33 by pivot pins 34. The clevises are connected to rods 35 and 36 which extend from air cylinders 37 and 38. The air cylinders 37 and 38 at their ends opposite the rods 35 and 36 are connected to a supporting angle iron 39 by pivot brackets 40 and 41.

The air cylinders 37 and 38 are of a size and length such that, when actuated to retract their respective rods 35 and 36, will lift the plate 22 free of the web 12 by an amount sufficient to permit splices to pass thereunder or to provide room for threading the single face web. The cotton belting used as a facing for the plate 22 serves as a frictional surface that protects the single face web. Typically, the installation of the air cylinders is such that when the piston rod is extended approximately two and a half inches, the pressure plate is in contact with the bridge guide exit roll 14. By using only two and a half inches of the three inch stroke of the air cylinders, the remaining one-half inch of stroke may be used by the operator through a controlling air regulator to place the desired amount of pressure or force upon the plate 22 to control corrugated web weave. With little or no air pressure being fed to the cylinders 37 and 38, the plate will tend to float since only the force of gravity will be acting thereon. In normal operating conditions, full control of a corrugated web of various grades and flute sizes can be accomplished with no flute damage by the use of air pressure in the range of 10–50 psi.

Figure 3:
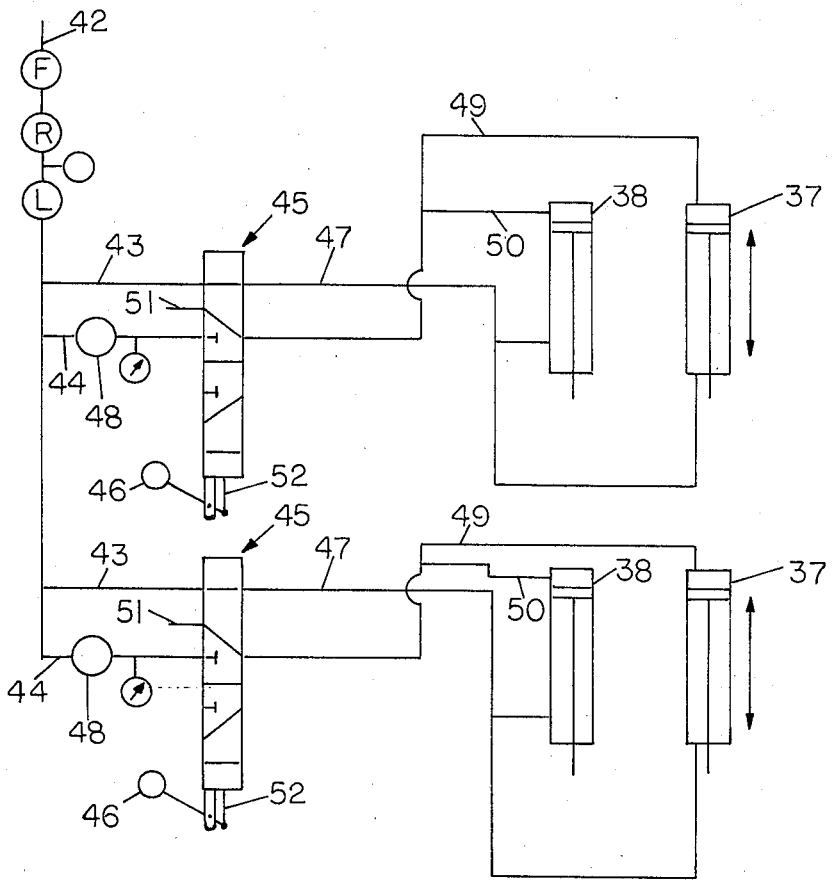
FIG. 3 is a schematic diagram of the pneumatic system for operating the invention.

With reference to FIG. 3, wherein a schematic air circuit and valving system is shown, the control for the cylinders will be described. Air under pressure from a plant source will enter through line 42, pass through a filter F, regulator R and lubricator L to branch lines 43 and 44. The controls are substantially identical with regard to the upper and lower bridge controls, thus identical reference numbers will be used to designate a second set of branch lines 43 and 44 which will operate on the air cylinders associated with the lower bridge. The branch lines 43 and 44 are connected to a four-way valve 45 which, in the position shown with its handle 46 in the up position, feeds air under pressure from line 43 through a line 47 connected to the lower ends of the cylinders 37 and 38. The branch line 44 which has a regulator 48 therein is blocked in the valve spool while at the same time the upper ends of the air cylinders 37 and 38 have their lines 49 and 50 connected and air will pass out through the valve 45 through an exhaust port 51. Pulling of the handle 46 downward will move a valve actuator 52 upward to move the lower portion of the spool into alignment with the lines 43 and 44 and effect a reversal of the cylinders 37 and 38 to apply pressure to the plate 22. The extent of the pressure that will be applied is determined by the setting of the regulator 48. This regulator may be what is termed a "Norgren Miniature Regulator" with gauge sold by F and W Ursem Company, Cleveland, Ohio.

The foregoing description of the invention has been given with respect to the making of double wall corrugated board. It should, however, be readily apparent that the invention has complete and full application to the formation of single wall board. For example, in many instances, the only board that is being made is single wall and in such case the upper bridge would not necessarily be used and the lower bridge would carry all of the single face board to the glue station and beyond where a single face would be made.

I claim:

1. Apparatus for preventing single face web weave at a bridge exit comprising:

an idler roll over which the single face web is drawn;

an elongated plate overlying said idler roll and having a length less than one-half the width of the web;

a horizontal pivot shaft extending parallel to the idler roll;

a pair of spaced-apart support arms connected to said pivot shaft at one end thereof and to the ends of said plate;

adjustable biasing means connected to the ends of said plate for biasing said plate into contact with the web on the roll; and means connected to said plate for raising said plate out of contact with said web to permit splices to pass thereunder without danger of tearing the web.

2. The apparatus of claim 1 wherein said plate has a length of approximately one-third the width of the single face web.

3. The apparatus of claim 1 wherein said plate is a steel plate having a thickness of about one-fourth inch.

4. The apparatus of claim 3 further including a 0.25 inch to 0.50 inch thick cotton belting covering said plate.

5. The apparatus of claim 1 wherein said biasing means comprises:

a pair of air cylinders;

means connecting one end of said air cylinders to a fixed, overhead beam; and swivel means connecting the other ends of said cylinders to the arms at the ends of said plate.

6. The apparatus of claim 5 wherein said cylinder actuating means comprises a source of air under pressure and valve means connecting said source to said cylinders for extending or retracting said cylinders.

7. The apparatus of claim 6 wherein said source of air is regulatable between 10 to 60 psi.

8. Web weave control for a corrugator bridge guide having an idler roll at its exit comprising:

an elongated plate positioned in overlying relationship to said idler roll of said bridge guide;

a pair of air cylinders connected between a fixed overhead support and the ends of said plate for raising and lowering said plate;

control means connected to said cylinders for operating said cylinders to raise or lower said plate; and adjustable pressure regulator means in the feed to said cylinders for controlling the pressing force of said cylinders on the plate.

9. The apparatus of claim 8 wherein said plate is covered with a canvas material on the web contacting surface thereof.

* * * * *